US007587770B1

(12) United States Patent
Reser et al.

(10) Patent No.: US 7,587,770 B1
(45) Date of Patent: Sep. 15, 2009

(54) THERAPY TABLE

(76) Inventors: Richard E. Reser, 1660 W. Market St., Tiffin, OH (US) 44883; Steve Corthell, 3335 S. Twp. Rd., 17, Tiffin, OH (US) 44883

( * ) Notice: Subject to any disclaimer, the term of this patent is extended or adjusted under 35 U.S.C. 154(b) by 0 days.

(21) Appl. No.: 11/837,531

(22) Filed: Aug. 12, 2007

Related U.S. Application Data

(60) Provisional application No. 60/838,543, filed on Aug. 18, 2006.

(51) Int. Cl.
*A47B 7/00* (2006.01)

(52) U.S. Cl. ..... 5/613; 5/617; 5/618; 606/240; 128/845

(58) Field of Classification Search ..... 5/612, 5/613, 617, 618, 616; 606/240–242; 128/845; 601/23, 24, 26
See application file for complete search history.

(56) References Cited

U.S. PATENT DOCUMENTS 3,945,063 A * 3/1976 Matsuura ..... 5/611
4,850,343 A * 7/1989 Scott ..... 606/245
5,468,216 A * 11/1995 Johnson et al. ..... 601/24
2005/0172404 A1 * 8/2005 Diller et al. ..... 5/616

* cited by examiner

*Primary Examiner*—Peter M. Cuomo
*Assistant Examiner*—William Kelleher
(74) *Attorney, Agent, or Firm*—Jerry Semer

(57) ABSTRACT

The article of manufacture is a therapy table. The table has a head rest, arm rests and two cushions that are shaped similar to the human body. The head rest and arm rests are adjustable to fit a person either lying in a supine or prone position. The head rest and arm rests can also be adjusted to fit patients of different sizes. The table is designed so that its bed can go from a flat position to a dynamic convex position. An electronic linear actuator moves a lift cam which pushes on the center section of the table moving the table into a convex position which becomes rigid due to support from the curved surface of lift cam. This motion distracts the facet joints minimally which allows for a much easier and much more general repositioning of the vertebrae. The height of the table is adjustable.

15 Claims, 4 Drawing Sheets

THERAPY TABLE

This application is a continuation-in-part of prior applications No. 60/838,543 that was filed on Aug. 18, 2006.

FIELD OF INVENTION

This invention relates to the field of therapy tables and more particularly to the field of therapy tables that can move from a horizontal position to a convex position.

BACKGROUND OF THE INVENTION

Chiropractic services and the manipulation of one's spine has become an important medical service. Chiropractors, through their manipulation of the spine can reduce or eliminate back pain. Chiropractors are especially used by many of today's athletes to help them perform better at their chosen endeavor. The applicant believes that a therapy table should be designed to place the patient in a position where the practitioner can easily deliver his manipulation. Also, the applicant believes that the table should be comfortable to the patient, but also gets the patient in a position that enables the practitioner to manipulate with maximum benefit for the patient. In the industry today most practitioners use a flat table. Although, a flat table is comfortable for the patient, it does not place the patient in a position that enables the practitioner to work on the patient with maximum efficiency. As a result many practitioners must place pillows or wedges under the midsection of the patient to achieve this benefit. This allows gravity to pull on the caudal and cephalic aspects of the patient providing traction like effect separating the facet joints of the spine and also providing for a posterial muscle stretch. By separating the facets, it enables the chiropractic practitioner to manipulate the back more easily and place it into the proper position. The stretch on the muscles also gives the patient a much more supple back. Applicant has developed a table that moves from a horizontal position to a convex position. This table then allows gravitational pull on the caudle and the cephalic aspects of the patient and provides a tractionized effect separating the facet joints of the spine and also providing the stretch of the muscles. Thus, a therapist can better reposition the vertebrae in the back and can do this more gently and more accurately. Applicant's table has also been designed so the head rest and the arm rests can be quickly changed for sizing the patient comfortably and makes the therapy less complicated. The patient may be placed on the table either in the supine or prone position for McKenzie and Williams therapy respectively. The height of the table and the curvature of the surface can be adjusted by the therapist to ensure that the patient is in the best position for therapy as well as being comfortable.

The main feature of the table is a flexible table top that allows a linear actuator and a lifting cam to move the table from a horizontal position to a convex position.

SUMMARY OF THE INVENTION

The article of manufacture is a therapy table. The table has a head rest, arm rests and two cushions that are shaped similar to the human body. The head rest and arm rests are adjustable to fit a person either lying in a supine or prone position. The head rest and arm rests can also be adjusted to fit patients of different sizes. The table is designed so that its bed can go from a flat position to a dynamic convex position through the use of a foot pedal by the therapist. When a therapist places his foot upon the pedal, an electronic linear actuator moves a lift cam which pushes on the center section of the table moving the table into a convex position. The table is made out of a flexible, ultra high molecular weight polyethylene and is able to bend from a flat surface to a radius of 20 inches and return again without breaking or warping. This allows the center of the table to rise up a maximum of 42 inches from the floor. When in the raised position, the table surface becomes ridged due to the support from the curved lift cam. This motion separates the facet joints minimally which allows for a much easier and much more gentle repositioning of the vertebrae. The height of the table is adjustable to ensure that the patient is in the most comfortable and best position for therapy.

DETAILED DESCRIPTION OF THE PREFERRED EMBODIMENT

Figure 1A:
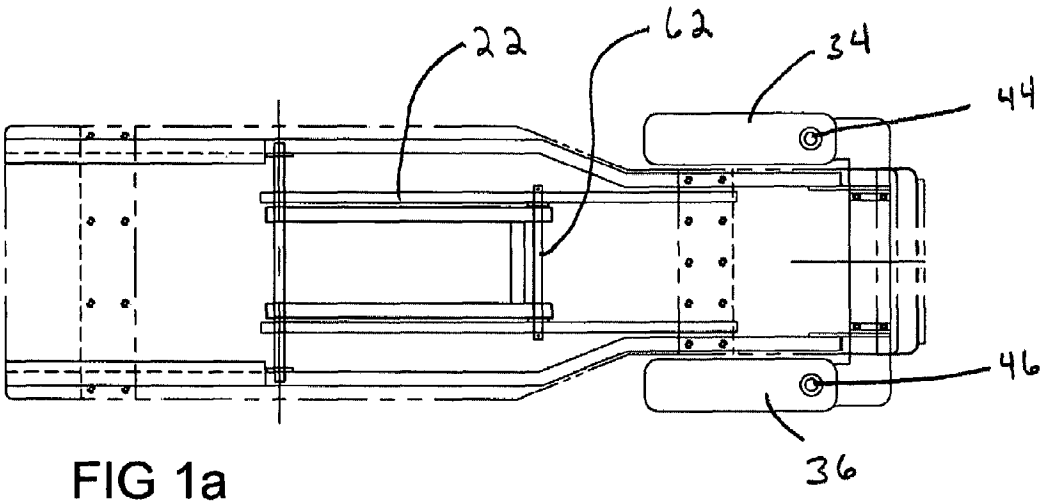
FIG. 1*a* is a top view of the invention with the cushions and the table top removed.
Figure 2:
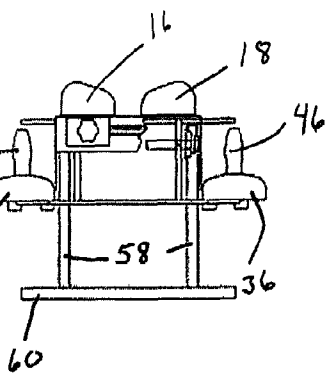
FIG. 2 is a front view of the invention with the table top in a flat position.
Figure 1:
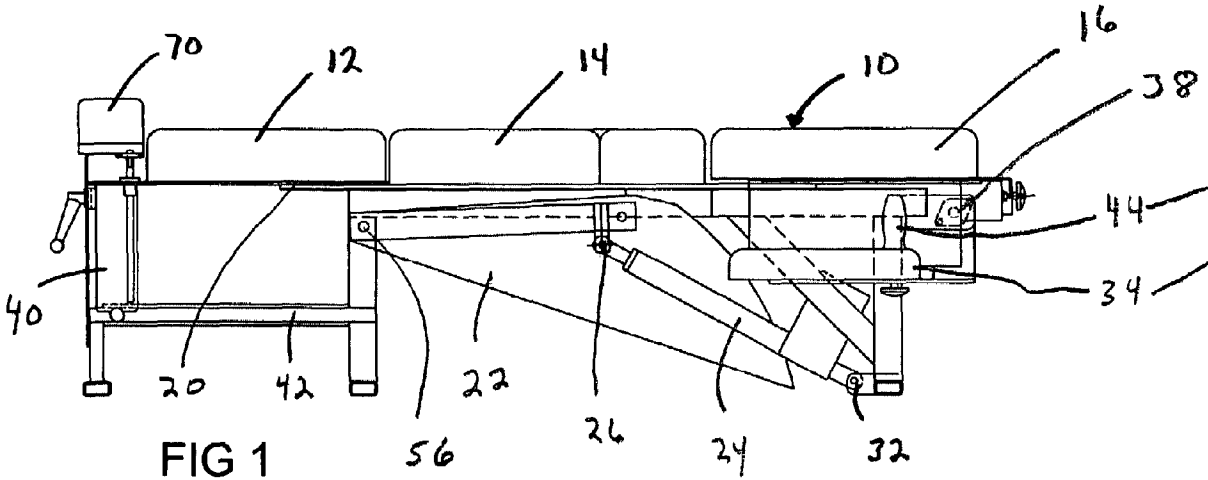
FIG. 1 is a side view of the invention with the table top in a flat position.

FIG. 1 is a side view of the invention 10 with the table in the horizontal or flat position. The table 10 has five cushions 12, 14, 16, 18 and 70. Foot cushion 70 at the end of the table and is where the ankles of the patient are positioned. Lower leg cushion 12 is position under the lower legs of the patient and between foot cushion 70 and middle cushion 14. Lower leg cushion 12 supports the knees of the patient. Middle cushion 14 lies in the middle of the table and supports the torso of the patient. Head cushions 16 and 18 are at the end of the table opposite the foot cushion 70. Only head cushion 16 is shown in FIG. 1. FIG. 2, a front view of the table 10, shows both cushion 16 and 18 which are designed as a head rest. FIG. 1 also shows the table top 20 underneath the cushion 12, 14, 16 and 18. The table top 20 in the preferred embodiment is made out of an ultra high molecular weight polyethylene attach to steel plates. This allows the table top 20 to bend from a flat surface to a radius of 20 inches. Other materials can be used to make the table top 20 that are exceptionally durable and are able to be bent to large radius. Applicant has found that the ultra high molecular weight polyethylene is the best for this as to price and durability.

Figure 3:
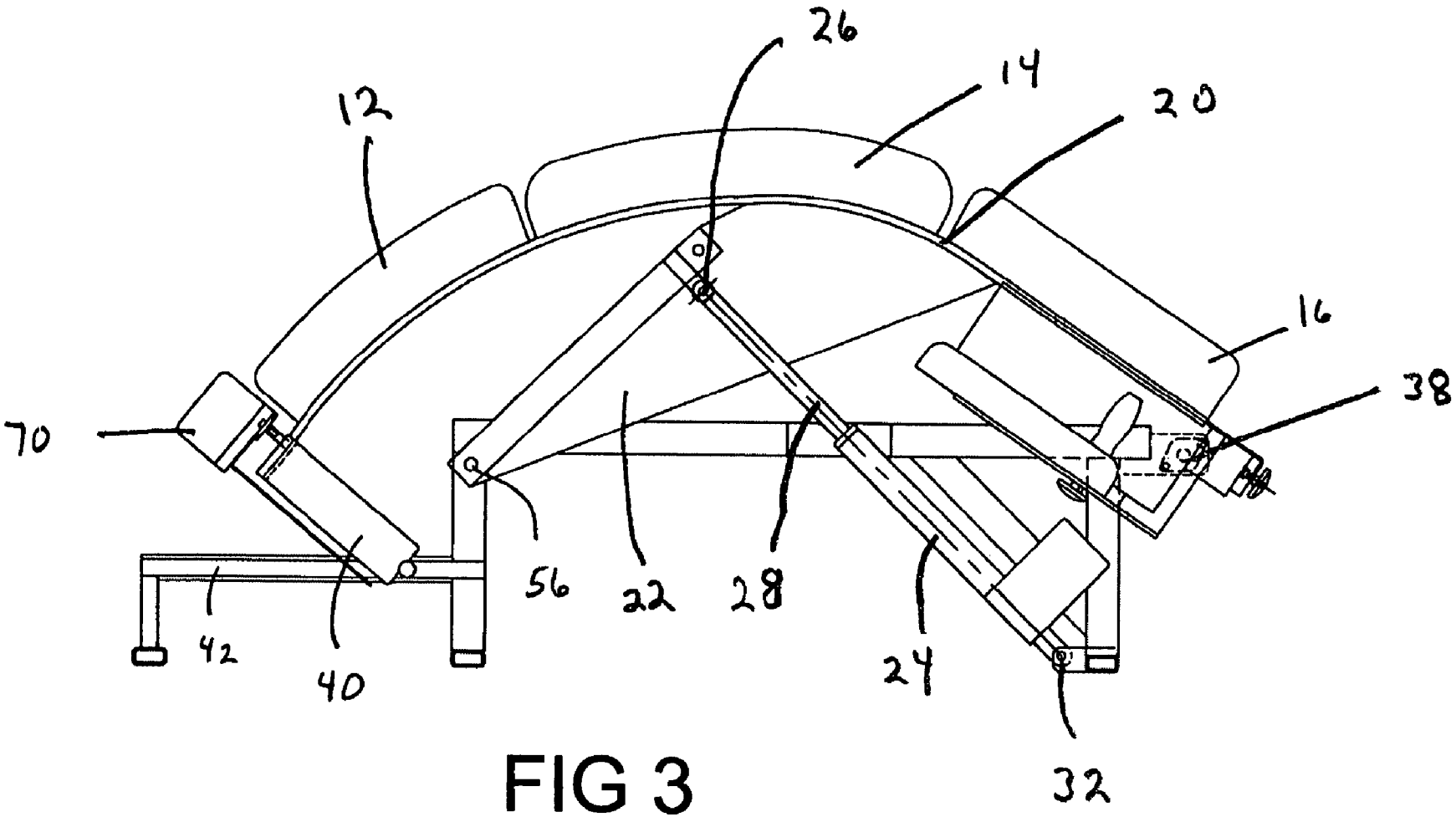
FIG. 3 is a side view of the invention with the table top in convex position.

Underneath the table top 20 one sees the lift cam 22 and the electric linear actuator 24. The electric linear actuator 24 is attached to a lift cam 22 by a first rotating bearing 26. As the electric linear actuators arm 28 slowly extends, it moves the lift cam 22 upward as the lift cam 22 slowly rotates around second pivotal bearing 56. The linear actuator 24 is attached to the under frame 30 of the table 10 by a third rotating bearing 32. The actuator 24 also rotates around third rotating bearing 32 as it extends, pushing lift cam 22 upward. The lift cam 22 lifts the table top 20 in an arc as shown in FIG. 3.

The table top 20 is attached to the under frame 30 by a pivotal bearing 38 at the head of the table 10 and a post 40 on a guided track 42 at the foot of the table 10. The post 40 slants inward as the lift cam 22 moves upward and post 40 moves along guided track 42 allowing the table top 20 to flex as the lift cam 22 moves upward. At the head of the table 10 under the head cushions 16 and 18 are arm rests 34 and 36 with grasping poles 44 and 46. An individual lying on the table 10 in a prone position can place his arms on the arm rests 34 and 36 and grab the grasping poles 44 and 46. As the bed moves upward when the electric linear actuator 24 lifts the lifting cam 22, the arm rest 34 and 36 and grasping poles 44 and 46 also slant upward with the table top 20 due to the pivotal bearing 38. The arm rests 34 and 36 with grasping poles 44 and 46 are attached to the table top 20.

Figure 4:
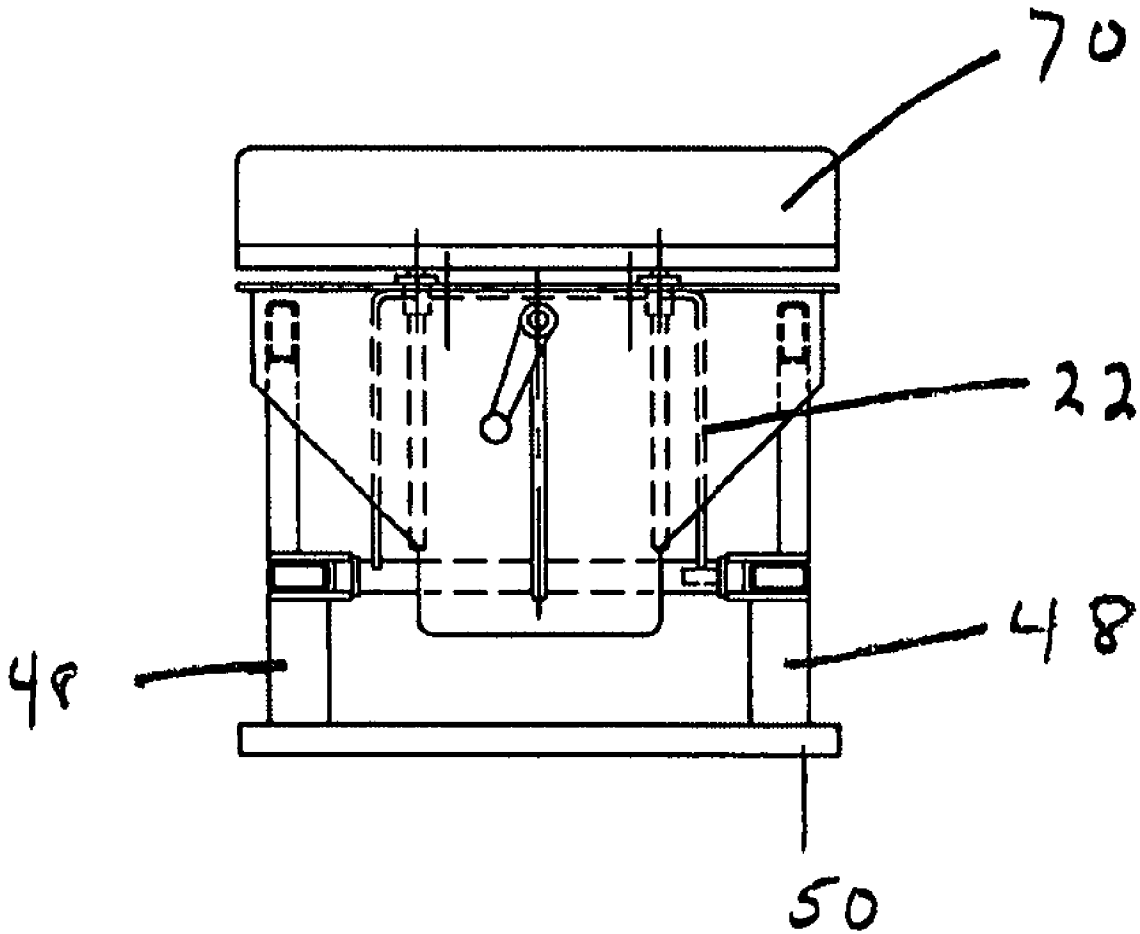
FIG. 4 is a back view of the invention with the table top in a flat position.

FIG. 4 is the back view of the invention. It shows that there are two back legs 48 at the back of the table 10. These back legs 48 are attached together at their bottom by back leg bottom piece 50. The back leg bottom piece 50 extends from each of the two back legs 48 outward. This allows for the table 10 to fit solidly on the floor and eliminates the possibility of the table 10 tipping. Post 40 shown in FIGS. 1 and 3 are on both sides of the table 10. Each of these posts 40 move along separate guided tracks 42. One post 40 is on each side of the table 10.

Figure 5A:
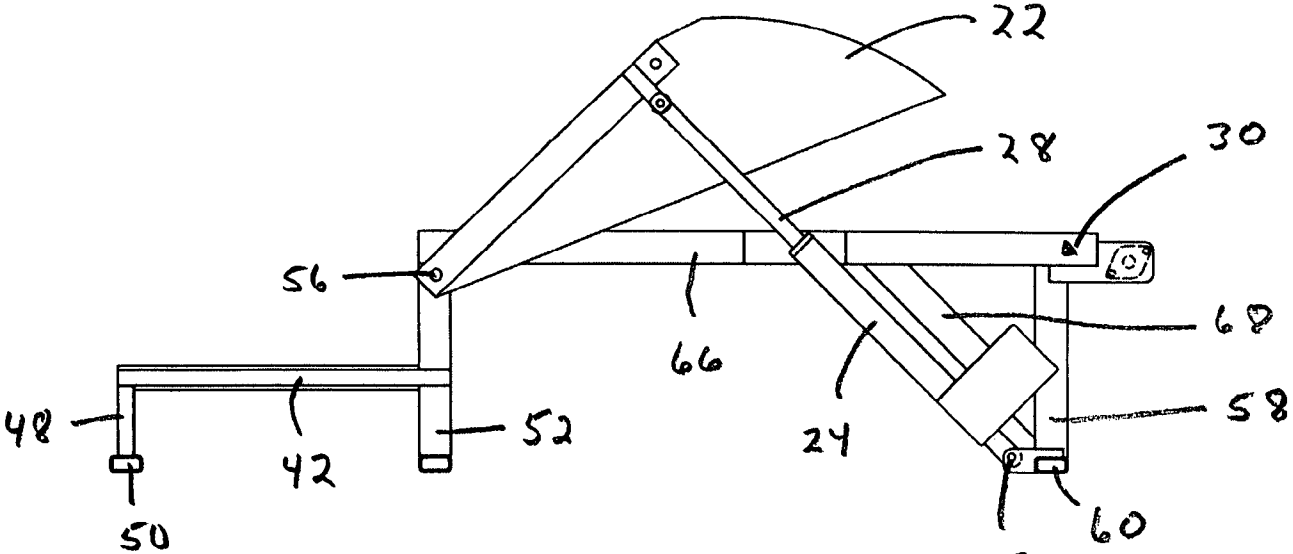
FIG. 5*a* is a side view of the frame with the linear actuator and the lift cam in the raised position.
Figure 5:
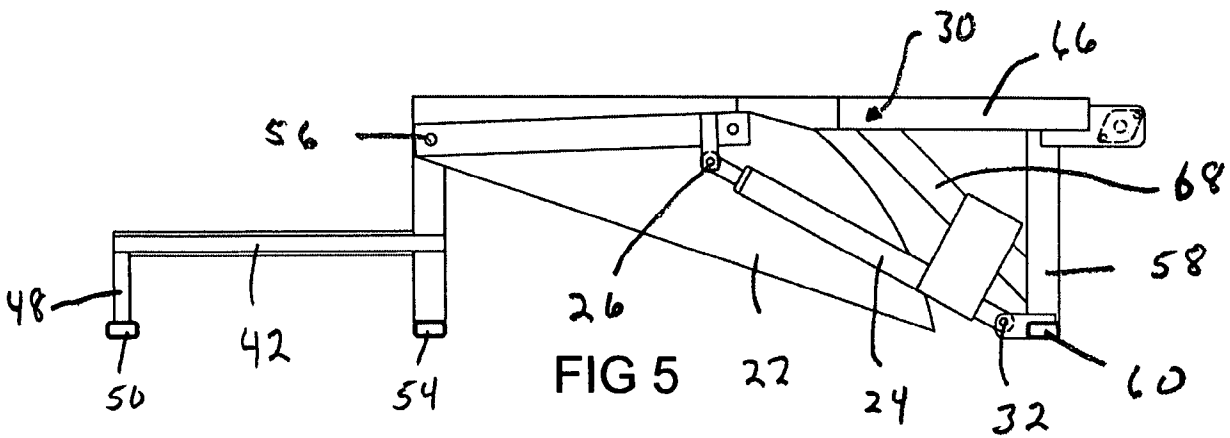
FIG. 5 is a side view of the frame with the linear actuator and the lift cam in the flat position.

The guided tracks 42 as shown in FIG. 1 and FIGS. 5 and 5*a* are attached to the two middle legs 52 of the frame 30. FIG. 5 is a side view of the frame 30 of the table in the flat position and FIG. 5*a* is a side view of the frame in the raised position. The two middle legs 52 as the back legs 48 are attached together at their bottom by the middle legs bottom piece 54. As with back leg bottom piece 50, middle legs bottoms piece 54 extents outward from each of the two middle legs 52. This is for stability for the table 10. Near the top of the middle legs 52, second pivotal bearings 56 are attached to the end of the lift cam 22. These second pivotal bearings 56 allow the lift cam 22 to pivot and actually lift the table top 20.

FIG. 2, the front view shows the two front legs 58 of the under frame 30. As the middle legs 52 and the back legs 48, the two front legs 58 are attached together by a front leg bottom piece 60 at their bottom. This front leg bottom piece 60 extends outward from each of the two front legs 58 to provide stability for the table and to ensure that the table will not tip over. Lift cam 22 is U shaped with the edges of the U being triangular with one edge of the triangle being curved. On the flat edge of the triangle the two sides of lift cams 22 are attached together by a top bar 62, as shown in the FIG. 1*a*. The electric linear actuator arm 28 is attached to the top bar 62 that passes between the two triangular edges of the lift cam 22. This top bar 62 is attached to the lift cam 22 by the first rotational bearing 26. When the linear actuator 24 extends its arm 28, the lift cam 22 moves upward with the flat side moving away from the table top 20 and the curved, rounding side moving up against the table top 20 causing the table top 20 to move into a concave position as shown in FIG. 3. The linear actuator 24 is attached to the bottom of the front legs 58 of the table 10 with a third rotating bearing 32. The frame 30 is further reinforced by a top reinforcement frame member 66 from the top of each front legs 58 to the top of each middle legs 52. The frame is also reinforced by an angular reinforcement member 68 that attaches to each of the front legs 58 and the each of the top reinforcement frame members 66. The table 10 in the head area is smaller to compensate for the arm rest 34 and 36 and grasping polls 44 and 46 at its side. It then tapers out near the mid section and then is much wider as it moves towards the foot end. There is a small foot cushion 70 at the very back that is adjustable in height so that it can be locked in a positions slightly higher than the other four cushions 12, 14, 16 and 18 which provides for enhanced patient comfort at the legs/knees.

Changes and modifications in the specifically described embodiments can be carried out without departing from the scope of the invention, which is intended to be, limited only by the scope of the appending claims.

The invention claimed is:

1. A table comprising:

(a) a horizontal flexible platform made out of a single sheet of flexible material with a top, bottom, and two ends of a length and width that is designed such that an individual can lay fully stretched out upon the platform; and, (b) cushions on top of said platform for an individual to lie upon; and, (c) a frame with legs to support the platform, said frame is attached to the platform in such that the table can be flexed from a horizontal position to a convex position; and, (d) a mechanism that can flex the platform from a horizontal position to a convex position when an individual is lying on the platform;

the mechanism that flexes the table comprises;

(i) a curved cam whose top edge is convex and said top edge is of similar curvature to the platform in the convex position and that is located near the center of the platform and makes contact with the bottom of the platform and controls the form of the platform when the platform is fully flexed; and, (ii) a bearing that attaches the platform to one end of the frame and allows the table to flex to the frame; and, (iii) a movable bearing that attaches the platform to the other end of the frame and allows the table to flex to the frame; and, (iv) a motor that is attached the cam and moves the cam to flex the platform into a convex shape.

2. A table as in claim 1 wherein:

(a) the flexible platform is made out of a flexible plastic material.

3. A table as in claim 2 wherein:

(a) the flexible platform is made out of an ultra high molecular weight polyethylene.

4. A table as in claim 1 wherein;

(a) the motor is a linear actuator attached to the cam that moves the cam and the center of the platform upward.

5. A table as in claim 1 wherein;

(a) the cam is semicircular in shape and makes contact with the platform along its convex side controlling the form of the flexing of the platform.

6. A table as in claim 1 wherein;

(a) the platform flexes as the cam is moved upward by the motor.

7. A table as in claim 5 wherein;

(a) as the cam moves upward, the bearing attached to the front of the platform rotates allowing the platform to flex.

8. A table as in claim 7 wherein;

(a) as the cam moves upward the movable bearing attached to the back of the platform moves towards the front of the platform and rotates allowing the platform to flex.

9. A table as in claim 8 wherein;

(a) the frame has a track that the moveable bearing moves upon.

10. A table as in claim 9 wherein;

(a) the height of the platform from the floor can be adjusted.

11. A table as in claim 9 wherein;

(a) the height of the platform above the floor is adjusted by adjusting the length of the legs.

12. A table as in claim 9 further comprising:

(a) a headrest on top of the platform for the comfort of a patient lying on the table.

13. A table as in claim 9 further comprising:

(a) a armrest attached to the platform for the comfort of a patient lying on the table.

14. A table as in claim 7 further comprising:

(a) a foot pedal that when pushed, activates the linear actuator and the linear actuator moves the cam and causes the platform to move from a horizontal position to a convex position.

15. A table as in claim 12 further comprising:

(a) a foot pedal that when pushed, activates the linear actuator and the linear actuator moves the cam and causes the platform to move from a horizontal position to a convex position.

* * * * *